US008413378B2

(12) United States Patent
Marocco

(10) Patent No.: US 8,413,378 B2
(45) Date of Patent: Apr. 9, 2013

(54) LOUVRE BLADE SEAL

(75) Inventor: Mario M Marocco, Toronto (CA)

(73) Assignee: Maxxmar Inc., Toronto, Ontario (CA)

( * ) Notice: Subject to any disclaimer, the term of this patent is extended or adjusted under 35 U.S.C. 154(b) by 514 days.

(21) Appl. No.: 12/155,463

(22) Filed: Jun. 4, 2008

(65) Prior Publication Data

US 2011/0099906 A1 May 5, 2011

Related U.S. Application Data

(63) Continuation-in-part of application No. 11/984,864, filed on Nov. 23, 2007, now abandoned.

(51) Int. Cl.
*E06B 7/098* (2006.01)

(52) U.S. Cl.
USPC ..... 49/74.1; 49/87.1; 49/489.1

(58) Field of Classification Search ..... 49/489.1, 49/493.1, 496.1, 74.1, 87.1
See application file for complete search history.

(56) References Cited

U.S. PATENT DOCUMENTS

| | | | | |
|---|---|---|---|---|
| 2,794,220 | A * | 6/1957 | Libman | 49/469 |
| 4,199,898 | A * | 4/1980 | Connor | 49/91.1 |
| 4,294,283 | A * | 10/1981 | Scharres | 137/599.02 |
| 4,541,328 | A * | 9/1985 | Brzezinski et al. | 454/336 |
| 6,810,620 | B1 * | 11/2004 | Anderson et al. | 49/74.1 |
| 2003/0213180 | A1 * | 11/2003 | Ueda | 49/489.1 |

* cited by examiner

*Primary Examiner* — Gregory J. Strimbu

(57) ABSTRACT

A shutter with a frame having side members and top and bottom members, and louvres mounted between the side members, and a control for controlling and tilting the louvres, and louvre seals at the top and bottom of the frame, the louvre seals being loosely supported on the top and bottom of the frame, the top frame loosely supporting the top seal in a vertically dependent position, and the bottom frame loosely supporting the bottom seal in an upright standing position, and which render the two louvre seals swingable to allow sealing contact by the top and bottom louvres, when the louvres are tilted closed, and which seals swing back to vertical when released by the louvres. In a preferred form the blade seals are incorporated in frame extensions, with the frame extensions being swingable on the frames, and being biassed to hang vertical when out of contact with the louvres .

5 Claims, 4 Drawing Sheets

LOUVRE BLADE SEAL

This application is a continuation in part of application Ser. No. 11/984,864 Entitled, LOUVRE BLADE SEAL, inventor Mario M Marocco, filed Nov. 23, 2007, since abandoned.

FIELD OF THE INVENTION

The invention relates to shutters of the type having a frame, and louvres rotatable in the frame, and a control connected to the louvres, for rotating them open and closed, and having louvre seals at the top and bottom of the frame which are flexible and swingable both ways for contacting the louvres and excluding light.

BACKGROUND OF THE INVENTION

Shutters for windows and doors usually have a frame, hinged to the window or door opening, and rotatable louvres extending across the frame, from side to side. The louvres are elongated blades, some with aerofoil shapes, and having pivots at each end along their central axis. A control typically a control bar is connected to the louvres. Moving the control bar rotates all the louvres. In this way the louvres can be tilted open for light and air, or tilted up or down and closed for privacy and to exclude light. Shutters have been made in this general pattern for hundreds of years.

In the past, shutters were usually made of wood. The control bar was connected to the louvres, in earlier designs, by a pair of wire staples, one secured to the control bar and the other secured to the louvre. More advanced systems have been developed, and such shutters now are commonly made of synthetic plastic materials, although wood is still preferred by some consumers.

Louvres must be fitted to window or door openings of a particular building.

The dimensions of these window or door openings may and usually do vary from one building to another, and from one room to another in a given building.

The first step is to measure the width and height of the opening.

The shutters must then be designed and made to fit those measurements.

The shutter frame is usually a rectangle with vertical side members and horizontal top and bottom members. The louvres must of course be of a length to fit from one side member to the other.

However, determining the number of louvres to be fitted into a shutter frame of a specific custom fitted measurement is more difficult. If there are too many louvres then when they are open there will not be sufficient space between them.

If there are too few louvres then they may not close completely at the top and bottom of the frame. Some degree of overlap or contact is required when the louvres are closed, to provide effective exclusion of light, and for privacy.

When tilted closed it is desirable that the louvres should close as tightly as possible. The purpose is to exclude light or at least to shade the interior from sun light as far as possible, and also of course to provide some privacy.

The louvres must therefor overlap when closed. At the top and bottom of the frame there is often no overlap. The top and bottom louvres simply tilt with their edges as close as possible to the top and bottom of the frame. In many cases there was a gap, and light was still admitted.

To satisfy these problems the manufacturer of the shutters sometimes built shutters with custom specific spacings between the pivot centres of the louvres. This would result in more or less overlap between louvres depending on the spacings between their pivot centres, but the variation should not be excessive, from one shutter to another, since this will change their aesthetic appeal.

In other cases, the manufacturer would use top or bottom frame members of different widths. This would simply take up any space left uncovered by the louvres.

However, this required the manufacturer to keep various different pieces of material, to provide frame members of the required width.

It might be thought that the louvres could be made in various widths, to answer this problem. This is not really practical. The louvres are usually of a predetermined width, for reasons of economy, and so as to avoid too many variables in manufacture.

The top and bottom louvres must still tilt as close as possible to the top and bottom of the frame, as explained above.

Even when great care is taken to ensure a close fit, it is inevitable that there will be some light admitted between the top and bottom louvres and the top and bottom of the frame, since here there is no overlap.

One approach towards this problem is shown in U.S. Pat. No. 6,810,620, R. Anderson Nov. 2, 2004.

In this system, there were adjustable frame extensions at the top and bottom of the frame. The extensions could be positioned at various degrees of extension from the frame, during manufacture.

Their purpose was to allow greater flexibility in the building of the shutter, and to enable what was essentially the adjustment of the width of the top and bottom frame members thereby enabling the fitting of a given number of louvres in frame, thereby allowing some variation in the height dimension of the frame.

By simply positioning the frame extensions at a greater or lesser distance, the top and bottom members of the frame could in effect be made taller or shorter.

However, this was not totally satisfactory. Adjusting the height dimension of the top and bottom frame members, in this way, would also change the way the louvres closed. The geometry of the whole shutter would be affected by extending or retracting the extensions. When the extensions were extended too far then the extension would contact the top and bottom louvres, before the rest of the louvres in that shutter had fully closed.

When the extensions were not extended a sufficient distance there would be no actual contact between the top and bottom louvres and the extensions, because the rest of the louvres in that shutter had already fully closed.

It is desirable to provide a shutter with a frame and louvres and a control bar and having louvre seals at the top and bottom of the frame, which are flexible and swingable both ways to provide for an overlap between the top and bottom louvres and the seals, and to provide good contact between the top and bottom louvres and the seals for the exclusion of light, when the shutter is closed.

BRIEF SUMMARY OF THE INVENTION

With a view to providing an improved shutter which satisfies these objectives the invention provides a shutter with a frame having side members and top and bottom members, and louvres pivotally mounted between the side members, and a control for controlling the louvres, and top and bottom seals at the top and bottom of the frame the seals being loosely supported on top and bottom supports in the top and bottom of the frame, with semi-arcuate mounting surfaces on the channels which render the seals, both at the top and the bottom being swingable, both ways, to allow sealing contact by the top and bottom louvres, when the louvres are tilted closed.

It will be appreciated that a consumer may close the louvres by rotating them to tilt down, or by rotating them to tilt up. When rotated down then the top louvre will swing the top seal in one direction, and the bottom louvre will swing the bottom seal in the opposite direction.

Conversely, if the consumer tilts the louvres up to close them then the top and bottom seals will be swung in the opposite manner.

The frame top and bottom members define top and bottom mouldings for loosely holding the top and bottom seals, and supporting them upright, when the louvres are tilted open.

The frame top and bottom members and seals have complementary surfaces for permitting swinging movement of the seals, while returning them to their upright positions when not contacted by a louvre.

Preferably the complementary surfaces are convex surfaces on the frame members, and concave surfaces on the seals.

Preferably the mouldings are channels, and the seals is formed with complementary root portions sliding loosely in the channels.

For this purpose the frame is formed with generally semi-cylindrical beads along each side of the channel, and the seals are formed with semi-arcuate concave surfaces along each side.

The seals define flexible blade elements, and enlarged root portions. The root portions define the surfaces engaging with the mouldings of the top and bottom frame members, and the blade elements can be deflected by contact with a louvre.

Where the mouldings are channels then the beads on the frame top member allow the top seal to suspend vertical from the top channel with semi-arcuate concave surfaces in contact, and the beads on the frame bottom member allow the bottom seal to stand upright in the bottom channel with semi-arcuate concave surfaces in contact, the top and bottom frame members being of identical cross section, and the top and bottom seals being of identical cross section.

The frame top and bottom members may define hollow channels of predetermined dimensions, with semi-cylindrical beads alongside the channels, and the top and bottom seals define a root portion of predetermined size less than that of said channels with said semi-arcuate concave recesses on either side, contacting the beads, and with the root portions being loose within the channels so that they can permit the seals to swing to one side or the other, when the louvres are tilted closed, but return to the vertical position, when the louvres are tilted open.

Optionally the frame moulding can be in the forms of rails of predetermined cross section, and the seal roots can define channels shaped to slide over the rails.

The complementary surfaces in this case would still be effective to hold the seal vertical, when not in contact with a louvre.

In one preferred form frame extensions are made which attach loosely to the top and bottom frames. Interlocking formations on the extensions and the frame, enable the extensions to swing to and fro. When at rest the extensions hang down, or stand up, vertically. The blade seals are secured on the extensions. When the louvres are swung fully closed the top and bottom louvres will contact the seals. The extensions will then swing, to allow full closure of the louvres.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As already described in general, a shutter (10) consists of a rectangular frame (12), with sides and a top frame member (14) and bottom frame member (16).

Figure 1:
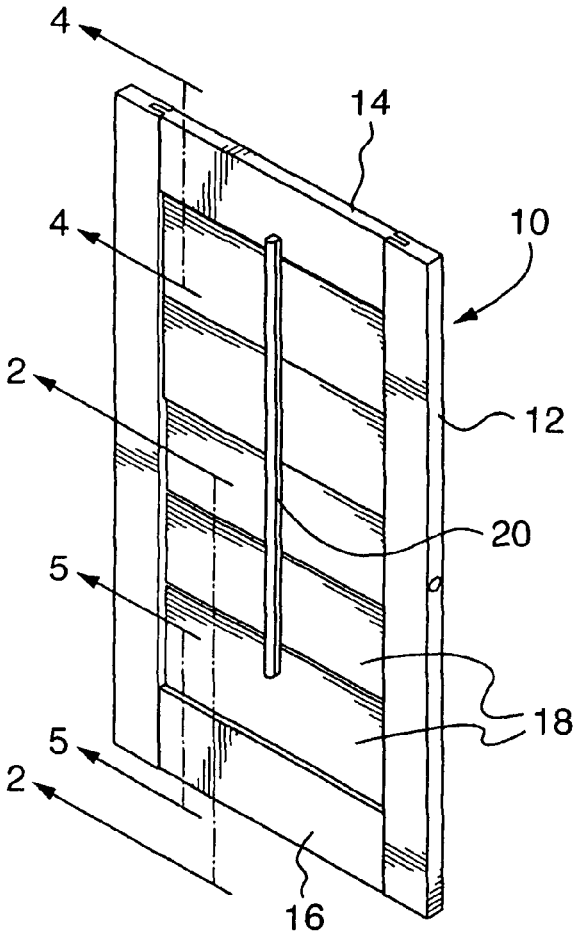
FIG. 1 is a perspective illustration of a shutter, having a frame and louvres, and louvre seals, illustrating the invention.

Louvres (18) are rotatably located between the two sides of the frame, and a louvre control, typically a control bar (20), FIG. 1 is connected to all the louvres. Operation of the control bar will tilt all the louvres in unison, either tilting up or down.

Typically the shutter will be hung by hinges (not shown) in a window or a door opening. As such the general construction, and the location and use of shutters is well known. The frame (12) may be of any suitable material, synthetic or natural.

Figure 2:
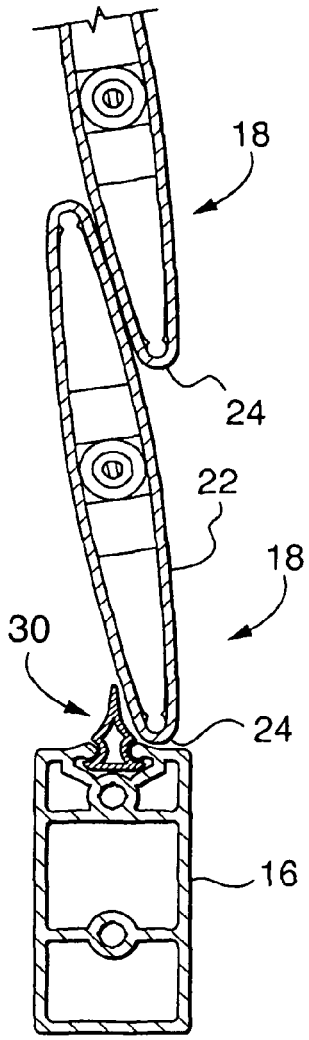
FIG. 2 is a section along line 2-2 of FIG. 1.

In accordance with one embodiment of the present invention, as illustrated the louvres are of extruded plastic construction and define a hollow interior, FIG. 2.

However, the invention does not exclude shutters with louvres made of other materials, which may be natural or synthetic.

In this description, as illustrated, the louvres (18) in this form of construction define a generally aerofoil shape in section, with upper and lower blade walls (22) of generally convex shape, meeting along edges (24). A hollow interior is not critical. The louvres can also be solid.

At each end each louvre is provided with a pivot (not shown) which fits in a receiving recess (not shown) in the side members of the frame (12).

The louvres (18) can be titled, either up or down, between open and closed position, to either admit light or exclude it. This also provides privacy. To tilt open or tilt closed the louvres all together, and maintain them all in a uniform position, a control such as control bar (20) is provided.

The louvres are connected to the control bar by any suitable hingable means. In this way movement of the control bar (20) will then cause all louvres to tilt together.

The louvres and the control bar can be made solid if desired.

It will be seen that the adjacent louvres overlap one another at their edges, when they are swung closed. It will also be apparent that the louvres can be tilted up or tilted down, as desired, and the option of the user.

However, in the regular shutter there is no overlap at the top and bottom of the frame. Light is admitted here even when the louvres are tilted closed.

In order to prevent this, top and bottom seals (30) are provided. Both top and bottom seals (30) are of extruded plastic material, in this embodiment and are identical in section.

Seals (30) define flexible louvre contact portions (32) which are of generally tapering cross section, being thinner at their free edges, and somewhat flexible.

Louvre contact portions (32) extend from root portions (34). Root portions (34) define complementary surfaces, which in this embodiment comprise two identical concave semi-arcuate side walls (36), forming root bearing surfaces, and a cross member (38) which is generally planar and has bevelled sloping edges.

Between side walls (36) and cross member (38) the interior of the seal (30) is hollow. The concave side walls (36) and cross member (38) define an exterior shape which is generally triangular in section, with two exterior concave side surfaces.

In order to support top and bottom seals (30) the top and bottom frame members (14) and (16) are formed with supports, in this embodiment with channels (40). The top and bottom members (14) and (16) are, in this embodiment of hollow extruded plastic construction. Channels (40) define diagonal interior walls (42) and mouth walls (44). Together they define an interior free space, for reasons to be described below. Complementary surfaces, in this case semi-cylindrical beads (46) of convex shape are formed on the free edges of channel mouth walls (44) and form seal root support surfaces.

The dimensions of the section of root portion (34) of seals (30) are substantially less than the dimensions of the hollow interior space defined within channel (40), so as to provide some clearance or free space for swinging movement of the root portions (34) within the channels (40) for reasons described below.

Figure 3:
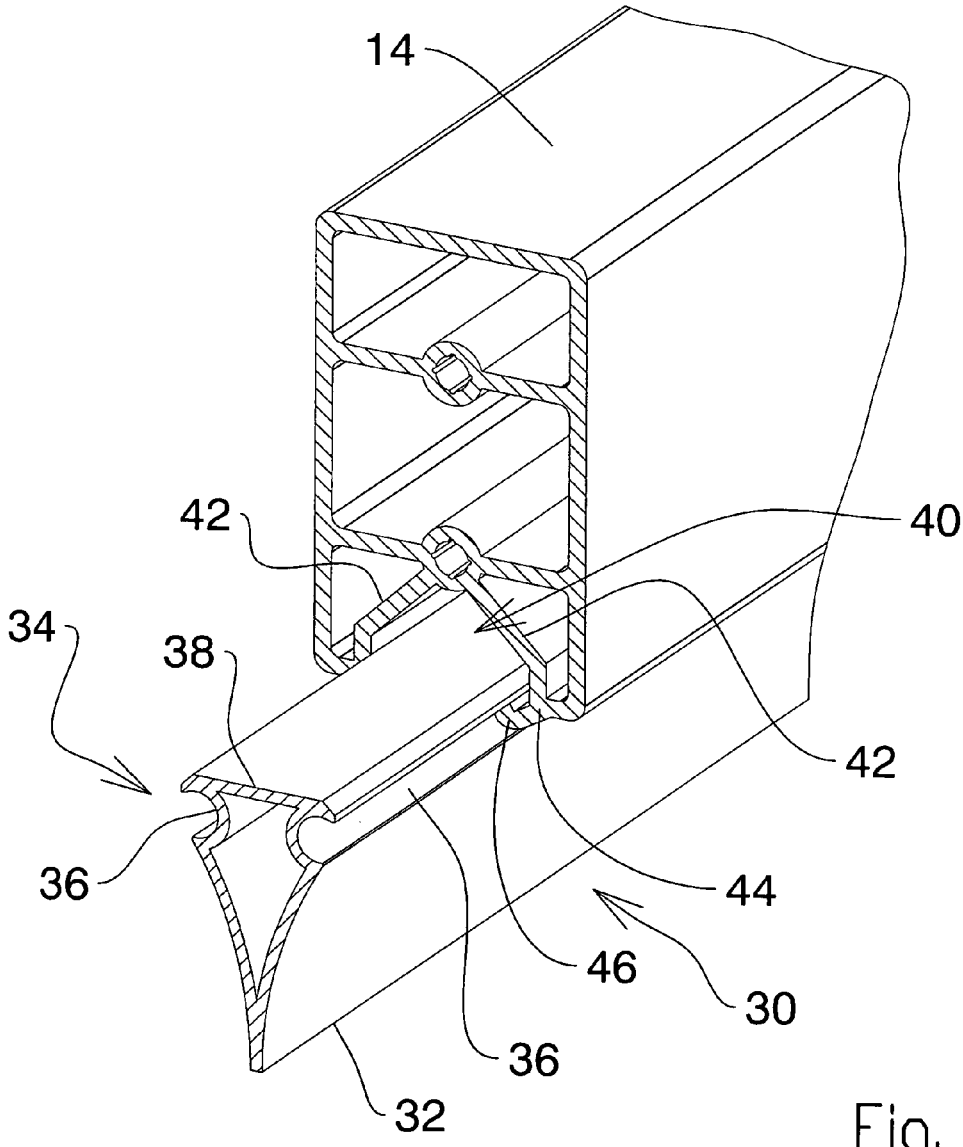
FIG. 3 is an exploded perspective illustration of a frame member and a louvre and a seal shown in isolation, with the frame member and louvre partially cut away.
Figure 4:
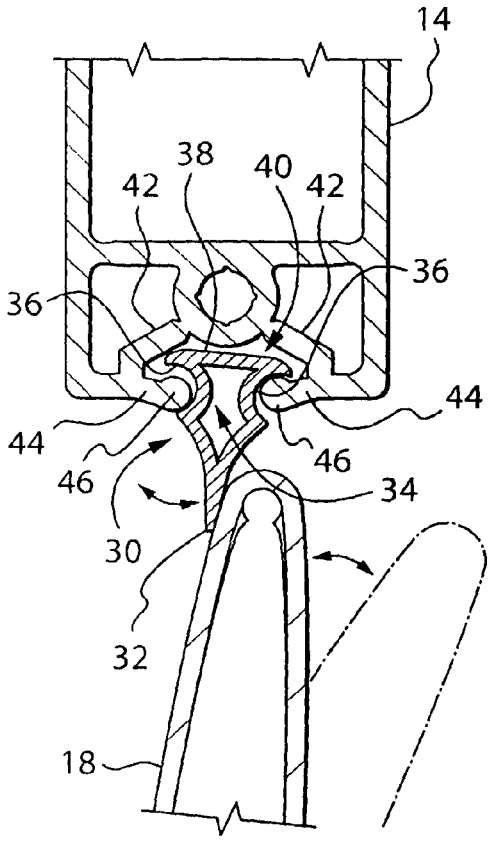
FIG. 4 is a section along 4-4 of FIG. 1, showing movement of the top seal in phantom.
Figure 5:
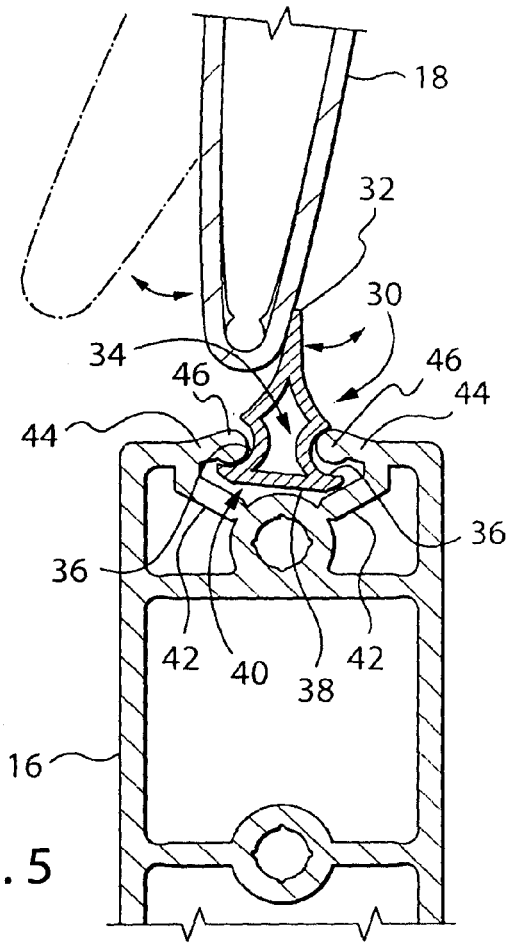
FIG. 5 is a section along 5-5 of FIG. 1, showing movement of the bottom seal in phantom.

Seals (30) are received in channels (40) of top and bottom frame members (14) and (16) FIGS. 3, 4, and 5. The concave side walls (36) and cross member (38) make a loose fit within channels (40)

The semi-cylindrical convex beads (46) of channels (40) interfit loosely with concave side walls (36) of seals (30).

The semi-arcuate shape of concave side walls (36) and the semi-cylindrical convex shape of beads (46), are complementary to each other and provide for swinging of the seals to and fro, in either direction.

The seals (30) at both top and bottom will normally be maintained in vertical planes, by the influence of gravity. Gravity will cause the top seal to hang down vertical. Gravity will cause the bottom seal to stand upright.

However, when contacted by the top and bottom louvre the seals will swing, in opposite directions, and allow the louvres to maintain good effective light sealing contact, from top to bottom of the shutter.

In the top frame member (14), the seal (30) will hang down in a vertical plane being suspended from the contact between inner portions of beads (46) and one portion of concave walls (36).

In the bottom frame member (16), the seal (30) will stand upright in a vertical plane because of the contact between outer portions of the semi-cylindrical beads (46) and another portion of concave walls (36).

When the louvres are tilted closed the top louvre will contact the contact portion (32) of the top seal (30). This will cause the top seal (30) to swing out of vertical, in one direction, but remain in contact with and overlapping the edge (24) of the top louvre. At the same time, the bottom louvre will also tilt closed and it will contact the contact portion (32) of bottom seal (30). This will cause the bottom seal to swing slightly, in a direction opposite to top seal (30). Bottom seal (30) and the bottom louvre will remain in contact. The louvre contract portions (32) may flex somewhat to ensure good light exclusion.

In this way, a good overlap and effective light seal is maintained at both the top and bottom of the shutter and all of the intervening louvres, as well.

When the louvres are tilted open, then the top seal (30) will swing back to vertical, and at the same time the bottom seal (30) will also swing upright.

The loose engagement between the complementary surfaces namely, concave surfaces (36) and the semi-cylindrical beads (46) provides that, in top frame member (14) the seal (30) can simply hang down from contact between the portions of semi-cylindrical beads (46) within the interior of channels (40) and the concave side walls (36), FIG. 4.

In the bottom frame member (16), the seal will stand upright, with the concave side walls (36) seated on the exterior portions of the semi-cylindrical beads (46) outside the channels (40), FIG. 5.

It will be noted that, at least in the bottom channel, the swinging of the seal out of vertical cannot go past a certain limit.

The concave wall surface, on one side of the root portion will contact and will be obstructed by the bead on the adjacent channel mouth wall, as the seal swings out of vertical.

In the top channel a similar limit is reached. In this way, contact between the top or bottom louvre with its adjacent seal, can displace the seal only to a limited extent.

Movement of the louvre beyond this point will simply deflect the flexible contact portion of the seal, without causing the seal itself to swing further.

This will in fact be a positive feature since it will improve the quality of the closure between the seal and the louvre, and better exclude light. The louvres may also be tilted closed, in a reverse manner.

In this case, the top and bottom seals will be contacted, and will swing in directions opposite to FIGS. 4 and 5.

It will be appreciated that the invention has been described as employing convex and concave surfaces for loose, swinging interengagement between the channels in the frame members and the seals.

This is believed to be the preferred and most effective form of interengagement for the purposes of the invention.

However, the invention is not restricted solely to channels in the frame members or to convex and concave surfaces. Other formations on the frame members and other planar or angled surfaces could provide such a support function in some cases.

Figure 6:
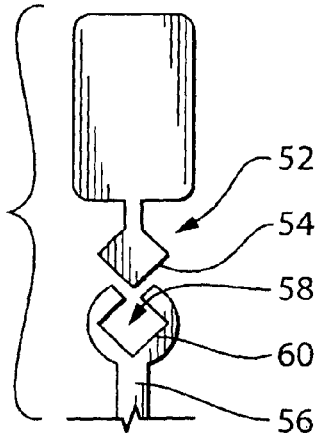
FIG. 6 is a section of an alternate embodiment.

For example, (FIG. 6), the top and bottom frame members can be provided with complementary mouldings in the form of rails (52). Rails (52) are formed with four angled surfaces (54) being in this case four sides of a rectangular section.

Seals (56) define root portions having complementary surfaces, in this case in the form of a channel (58) having four interior angled walls (60) complementary to the four angled surfaces (54) of rails (52).

It will be seen that the top seal will hang down vertical, until contacted by a louvre. Bottom seal will stand upright until contacted by a louvre.

The interengagement between the respective angled surfaces will maintain both top and bottom seals vertical.

However, the top and bottom seals can swing to and fro when contacted by respective top and bottom louvres.

Figure 7:
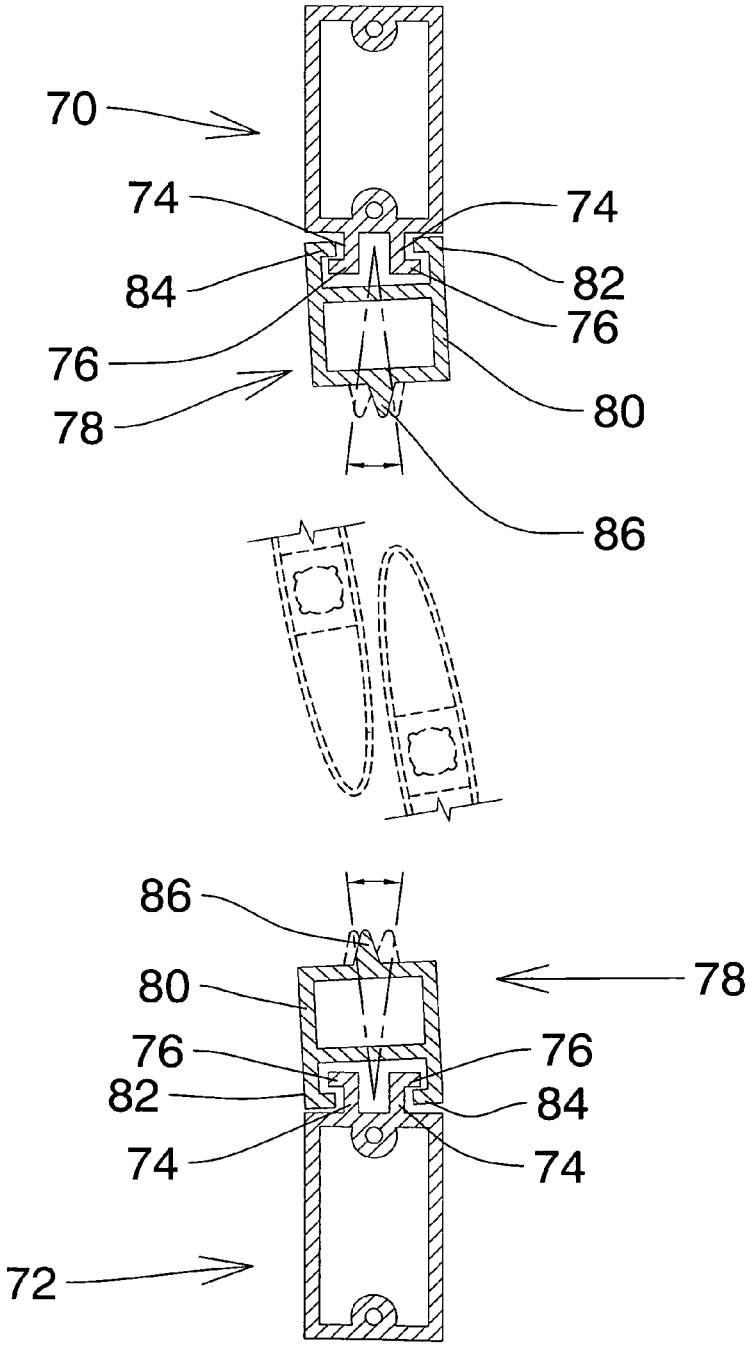
FIG. 7 is a side elevation partly cut away showing a further embodiment.

In a further embodiment shown in FIG. 7, the top and bottom frame members (70) and (72) are formed with pairs of spaced apart L-shaped connectors having stems (74) and generally planar outwardly directed cross members (76).

Frame extensions (78) are formed, of hollow tubular generally rectangular shape in section, having rectangular shoulders (80). The section corresponds to and complements the shape and appearance of the frames (70,72) themselves, and thus they are of the same width as frames. In this way the frame extensions (78) and the frames (70) and (72) appear as having a uniform pleasing and aesthetic appearance. Frame extensions (78) are formed with interlocking loose connecting channels formed by side walls (82) and inturned ribs (84). The side walls (82) and ribs (84) define a recess for receiving stems (74) and cross members (76) of the L-shaped connectors. The spaced apart stems (74) extend across the space between the ribs (84). The spacing between the stems (74) and cross members (76) of their respective frames is sufficient to enable a loose fit with the ribs (84). Stems (74) and cross members (76) are thus centred by and loosely engaged by ribs (84). Ribs (84) are of generally planar rectangular shape. Thus at the top frame (70), the extension can hang down from the cross member (76) in a vertical plane. At the bottom frame (72) the ribs (84) of the extension can be seated on the frame, and thus support it in a vertical plane.

To seal with the louvres when they are swung closed, louvre seals (86) are provided. These are generally tapering blade like formations. The seals will contact the louvres when the louvres are swung closed, in the same way as the seals in FIGS. 1 to 6. The seals will rock to one side when the louvres contact them. The seals will rock to and fro so that the extensions and seals hang (or stand) vertical, when the louvres are opened. The seals are formed integrally with the extensions, in this embodiment. The seals could however be formed separately, and of flexible material, and then attached to the extensions for example by complementary extrusions, which might be generally similar to the extrusions shown in FIGS. 1 to 6, or by adhesive or the like.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter comprising a frame having side members and top and bottom frame members, and a plurality of louvres mounted between the side members said louvres including top and bottom louvres and intermediate louvres; a control for tilting the louvres between open and closed positions;

seal support formations on said top and bottom frame members;

top and bottom swingable seals each swingably supported on a respective one of said top and bottom frame members;

each of said seals including a seal root portion which is received by a respective one of said support formations;

each of said root portions including a pair of side walls each defining a generally concave semi-arcuate bearing surface and a cross member extending between said side walls, and enclosing a hollow interior; each of said cross members being generally planar with beveled edges and, with a respective said pair of side walls, each of said seals including a flexible resilient louvre contact portion oriented to contact a respective one of said top and bottom louvres said seal support, formations swingably engaging said bearing surfaces, the seals being swingable relative to said top and bottom frame members to allow sealing contact between each of said contact portions and said respective one of said top and bottom louvres when the louvres are in said closed position, each of said seals defining a generally triangular shape in cross section;

said seal support formations and said bearing surfaces being complementary, and ensure that said top and bottom seals remain vertically oriented when not engaged by said respective one of said and bottom louvres.

2. A shutter as claimed in claim 1, wherein said support formations comprise semi-cylindrical beads and wherein said top seal is suspended vertically from said beads of said top frame member, and wherein said bottom seals stands upright on said beads of said bottom frame member.

3. A shutter as claimed in claim 1, wherein said seal support formations define channels having a first predetermined width, and wherein said root portions of said seals define a second predetermined with smaller than said first width for permitting swinging of said seals relative to said top and bottom frame members.

4. A shutter as claimed in claim 3, wherein said support formations include semi-cylindrical beads extending along said channels, contact the beads, whereby said top frame member suspends said top seal vertically from the top frame member, and whereby said bottom frame member supports said bottom seal.

5. A shutter as claimed in claim 1, wherein said seal support formations to comprise rails.

* * * * *